United States Patent [19]

Demuth

[11] Patent Number: 5,031,280

[45] Date of Patent: Jul. 16, 1991

[54] METHOD AND APPARATUS FOR CLEANING CARD SLIVERS PNEUMATICALLY THROUGH SPREAD SLIVER

[75] Inventor: Robert Demuth, Nuerensdorf, Switzerland

[73] Assignee: Maschinenfabrik Reiter AG, Winterthur, Switzerland

[21] Appl. No.: 454,852

[22] Filed: Dec. 22, 1989

[30] Foreign Application Priority Data

Dec. 23, 1988 [DE] Fed. Rep. of Germany ..... 3843655

[51] Int. Cl.[5] ..... D01G 1/00

[52] U.S. Cl. ..... 19/200; 19/150

[58] Field of Search ..... 19/200, 203, 150, 151, 19/303, 157

[56] References Cited

U.S. PATENT DOCUMENTS

| | | | |
|---|---|---|---|
| 2,274,425 | 2/1942 | Miller | 19/150 |
| 3,307,227 | 3/1967 | Bryan, Jr. | 19/200 |
| 4,051,653 | 10/1977 | Mitteregger | 19/150 |
| 4,060,966 | 12/1977 | Konig | 19/150 |
| 4,127,920 | 12/1978 | Gasser | 19/157 |
| 4,475,272 | 10/1984 | Wood | 19/150 |
| 4,827,574 | 5/1989 | Nakano et al. | 19/200 |

FOREIGN PATENT DOCUMENTS

| | | | |
|---|---|---|---|
| 0050933 | 5/1982 | European Pat. Off. | 19/200 |

*Primary Examiner*—Werner H. Schroeder
*Assistant Examiner*—John J. Calvert

[57] ABSTRACT

A method and an apparatus for cleaning a carded sliver during a movement of the latter in its longitudinal direction is disclosed. The carded sliver is guided over at least one guide surface having perforations which leads to spreading and loosening of the sliver, and an air flow is generated through the perforated guide surface in order to remove loose contaminations and also dirt and dust particles present in the loosened sliver. The air flow emerging from the carded sliver and carrying dust and dirt particles is preferably drawn off.

30 Claims, 4 Drawing Sheets

Fig. 1
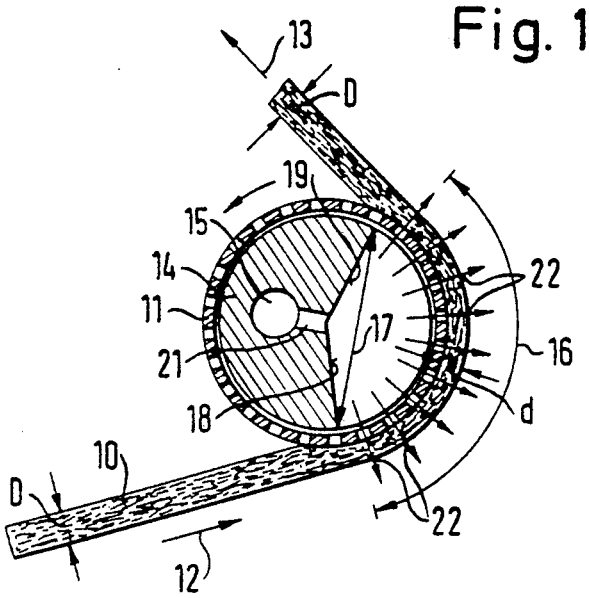
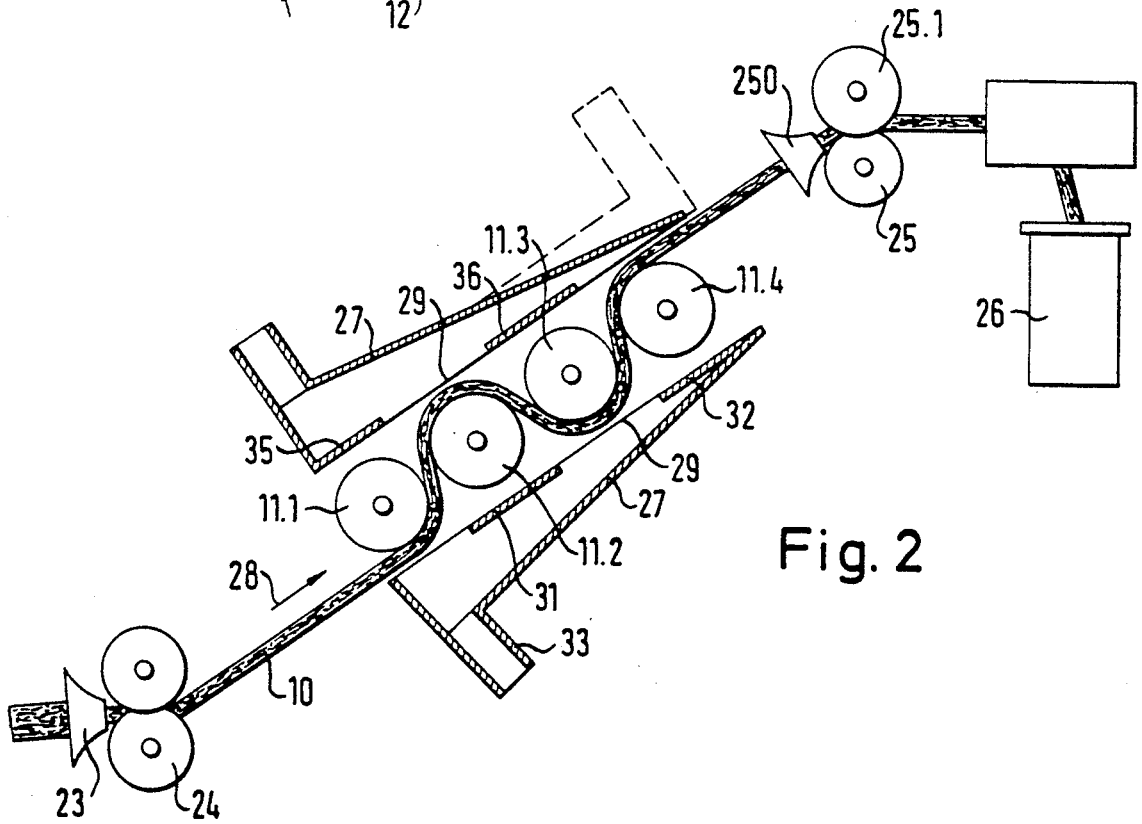
Fig. 2

METHOD AND APPARATUS FOR CLEANING CARD SLIVERS PNEUMATICALLY THROUGH SPREAD SLIVER

BACKGROUND AND FIELD OF INVENTION

The invention relates to a method and an apparatus for cleaning a carded sliver.

In the spinning of cotton one endeavors to remove dirt, dust, shell parts and contamination of all kinds from the cotton at almost every stage up to the spinning process. Such efforts have been successful to a large degree. However, there remains room for still further improvements.

With the increase of machine harvesting of the cotton flocks, the level of contamination of the cotton flocks has necessarily increased, so that the cleaning problem in all stages of cotton spinning is still a very real problem. In addition to this comes the fact that one endeavors to operate at high speeds of production, so that the time for carrying out cleaning processes is shorter and the requirements placed on cleanliness of the cotton are increased.

So far as it is known no proposal has so far been made for a cleaning of the carded sliver between the outlet of the card and the sliver coiler.

SUMMARY OF THE INVENTION

An object of the present invention is to provide a cleaning process and a cleaning apparatus which, with minimal expense and without complicating the production process as a whole, cleans the carded sliver. This cleaning typically takes place between the outlet of the card (in particular after the stepped rollers which compress the card sliver) and the band coiler.

In accordance with the invention, the carded sliver is guided around at least one convexly guide surface having perforations, which leads to a spreading or loosening of the sliver. A gas stream (preferably an air stream) is generated through the perforated guide surface in order to remove loose contamination and also dust and dirt particles present in the loosened dirt.

The method of the invention thus aims at producing spreading and loosening of the sliver by guiding this sliver around a convexly curved guide surface so that on the one hand contamination contained in the sliver is itself somewhat loosened, i.e., the binding to the fibers is reduced, while the sliver itself is made more permeable for the air flow so that the cleaning action of the air flow also increases.

Although the carded sliver represents a relatively weak structure, it has sufficient strength after being compressed in the stepped rollers at the outlet of the carding machine to be drawn over a curved guide surface while being blown through without the cohesion of the sliver being disturbed and without a significant number of fibers being lost from this fiber assembly.

The gas flow which passes through the carded sliver is preferably sucked away so that both the contamination which has been separated out and any fibers which may have been freed do not contaminate the machine area. The carded sliver is preferably moved in snake-like manner around several aspirated convex guide surfaces. In this way one succeeds in cleaning the carded sliver several times within a relatively short distance and a common suction device can be used so that the total expenditure can be kept within limits.

A particularly preferred apparatus for carrying out the method is one in which the perforated guide surface is formed by a perforated cylinder which rotates in operation and within which there is provided a body having a gas outlet opening which guides the gas flow, with the gas outlet opening being arranged in the region where the sliver wraps around the cylinder.

Although a stationary guide surface is possible, the use of a rotating perforated cylinder for the guide surface has the advantage that no undesired strains arise in the carded sliver due to matching of the peripheral speed of the cylinder to the through-flow speed of the carded sliver. It is also possible to do away with a direct drive of the perforated cylinder and simply to allow the latter to rotate about its own axis of rotation together with the moving sliver as a result of the friction between the sliver and the cylinder. In this way one can indeed do away with the need for a special bearing for the cylinder, because the cylinder can simply slide on the surface of a body arranged within the cylinder. Should this not be satisfactory due to the friction which occurs, then one can also consider allowing the cylinder to be driven by the gas flow. For example, one end face of the cylinder may be formed as a turbine. As a result of the low forces that are required, causing the cylinder to act as a turbine can be achieved by simple plate surfaces and aimed blowing nozzles.

A suction means is preferably provided in the wrapping region and on the side of the carded sliver remote from the cylinder. This suction means can be exploited for a dual purpose in that it not only removes the contamination separated from the carded sliver but also partially or fully serves to generate the gas flow. Stated more precisely three possibilities exist of generating the gas flow. One may blow gas through the body, or one may generate the pressure difference required for the gas flow by the suction means, or one may use a combination of blowing and sucking in that one both charges the body guiding the gas flow with pressurized gas from a pressure gas source and also generates a suction effect through the suction means.

Several perforated cylinders are preferably provided in a row in the direction of movement of the sliver with the sliver being partly wrapped around the cylinders in snake-like manner and with a suction means being provided on at least one side and preferably on both sides of the cylinders.

In an arrangement of this kind the suction means can have the form of a box through which the carded sliver runs with the box surrounding the row of cylinders and having a suction connection.

As an alternative, the (or each) suction means can have the form of an elongate trough which tapers in the direction of movement of the carded sliver, or in the opposite direction, and which is arranged with its open side facing the carded sliver. In this preferred embodiment the suction connection is provided at the broader end of the trough. Through the use of two such suction devices, one succeeds in completely removing the loosened contamination and at least one of the suction means can be made so that it can be pivoted away so that the cylinder row is readily accessible for servicing purposes and for starting up operation of the cleaning device. The tapered form of the suction means takes account of the fact that the quantity of air in the trough increases in the direction of the suction end. Through the tapered form one can thus uniformly distribute the suction action over the cylinder row while simultaneously maintaining the speed of acceleration at the individual cylinder.

In order to avoid the sucking in of leakage air, and in order to increase the flow speeds with a moderate air consumption, provision is preferably made that the open side of the trough is only open at positions where the sliver runs between the cylinder and the trough, so that no unnecessary suction effect takes place at the rear sides of the cylinders where there is no flow through the sliver.

Although the spreading of the sliver is increased during the movement around the cylinder or cylinders, a further development of the invention envisages that the or each cylinder is also formed to execute oscillations, for example axial and/or radial oscillations and/or the gas stream is a pulsating gas stream. These represent measures which can lead to further loosening of the sliver and separation out of the dust and contaminating particles which are present.

BRIEF DESCRIPTION OF THE DRAWINGS

These and other features and advantages of the invention will now be explained with respect to embodiments illustrated in the drawings in which:

FIG. 1 is a schematic representation of the cleaning method of the invention in which the sliver is deflected around a single aspirated cylinder;

FIG. 2 is a schematic illustration of a further apparatus of the invention with four aspirated cylinders arranged in a row and with suction means being provided;

DETAILED DESCRIPTION OF PREFERRED EMBODIMENTS

Figure 3:
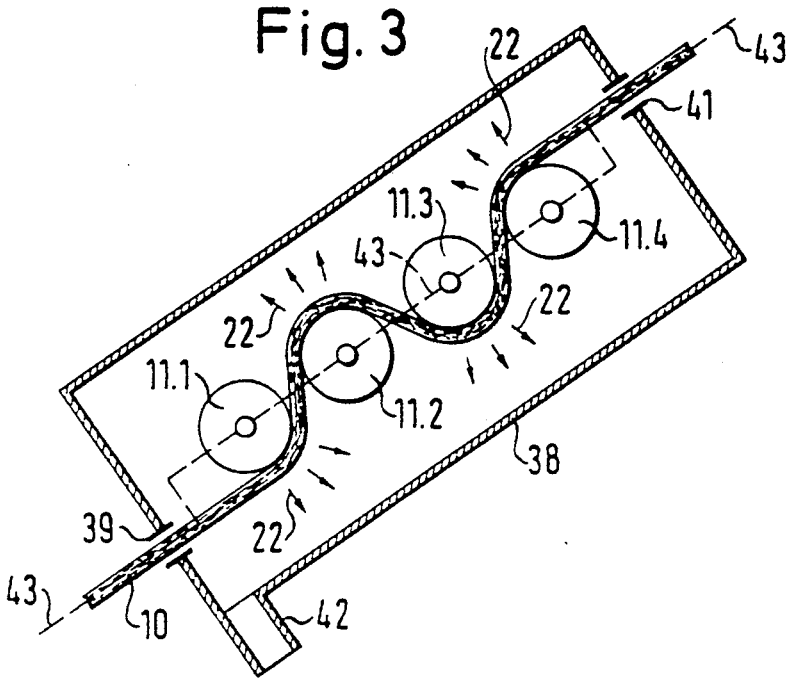
FIG. 3 is an illustration similar to FIG. 2 but showing an embodiment having modified suction means.

FIG. 1 shows a carded sliver 10 which is deflected from the direction of the arrow 12 into the direction of the arrow 13 round a guide surface formed by a perforated cylinder 11. Within the perforated cylinder there is located a stationary body 14 which has a guide duct 15 for compressed air. The guide body is provided with a gas outlet opening 17 in the deflection region 16 of the carded sliver and this gas outlet opening is defined by two approximately radial surfaces 18 and 19 which define an angle with one another. The air supply duct 15 communicates with this air outlet opening via a slot-like duct portion 21. As can be seen in the drawing, the thickness of the carded sliver 10 is reduced from the initial thickness D to a thickness d during the deflection and attains the original thickness D again after leaving the cylinder. In the deflection region where the thickness of the carded sliver d is reduced, a spreading of the sliver takes place in the direction perpendicular to the plane of the drawing, which increases the air permeability. The spreading movement also contributes to a loosening of any dust and contaminating particles contained in the carded sliver.

The air (arrows 22) which flows out through the opening 17 penetrates the fiber sliver 10 in the deflection region and removes loose contamination and dust particles. In this embodiment the cylinder 11 is simply driven by friction with the carded sliver itself. It slides as it were on the part cylindrical rear side of the body 14.

It is however also feasible to drive the cylinder 11. This can be achieved, for example, by approximately radially directed blades on the one end face of the cylinder and blowing nozzles which cooperate with the blades and which are fed from the duct 15.

Although not shown here the air (arrows 22) which penetrates the carded sliver 10 can and will normally be removed by a suction means which covers over or surrounds the deflection region 16 of the carded sliver. It is also evident that the gas flow which is illustrated by the arrows 22 can be generated either by the connection of an air source to the duct 15 or through a suction means, as described above, or by combination of these two possibilities.

FIG. 2 shows a preferred embodiment of the apparatus of the invention. At the bottom left it is first of all shown how the sliver coming from the carding machine first runs through a funnel 23 and then through a stepped roller pair 24 at the outlet of the carding machine. Directly thereafter, the somewhat compressed carded sliver is guided in snake-like manner around four cylinders 11.1, 11.2, 11.3, and 11.4 which are arranged in a row. These cylinders can be constructed as shown in FIG. 1, however only with the difference that the opening of the respective inner body always faces the deflection region of the carded sliver at the associated cylinder. After leaving the fourth cylinder 11.4 the carded sliver passes through a funnel 250 and a pair of rollers 25 and 25.1, preferably formed as a stepped roller pair, to a sliver coiler which is only shown schematically, but not to scale, and which designated with the reference numeral 26.

Above and beneath the cylinder row there are provided respective suction devices 27 of substantially the same construction. The lower suction device has approximately the shape of an open trough which tapers in the direction of sliver movement along the cylinder row, i.e. in accordance with the arrow 28. The open side 29 of the trough faces the cylinder row. It is however covered over in the regions 31 and 32 by cover plates since here no suction is required and in this way one can avoid leakage air flows and can thus also achieve the desired high air flow speed with moderate suction power.

As can likewise be seen from FIG. 2, the suction stub 33 is arranged in the lower region of the trough so that dirt and dust particles are also transported to this point by gravity. The arrangement is also inclined so that the rear side of the trough serves as a kind of slide for the particles of contamination which are separated out there. Although the illustrated arrangement is the preferred arrangement, it is also conceivable that one could place the suction connection at the upper end instead of at the lower end if one operates with higher air flow speeds, so the danger of particles of contamination separating out before the suction connection need not be feared.

As already mentioned, the upper trough 27 is similar to the lower trough but is oriented differently, and the cover regions 35 and 36 are somewhat differently arranged. However, even these differences would be unnecessary if the upper trough 27 were so arranged that the suction connection was disposed at the top end, as is illustrated in broken lines in FIG. 2.

FIG. 3 shows a somewhat modified embodiment in which the series arrangement of four cylinders is retained and these are accommodated in a suction box 38. In this embodiment the sliver runs through two guides 39 and 41 at the entry and outlet ends of the box respectively. The suction stub 42 is provided at the lower end of the box which is arranged in an inclined position. The suction stub could however also lie at the upper end or in the middle. The arrow 22 also shows here the directions in which the air emerges from individual cylinders 11.1 through 11.4. The broken line 43 indicate how the box is constructed in two parts so that it can be opened in order to provide access to the cylinders. In this embodiment the gas guiding bodies 14 of the cylinders 11.1 through 11.4 extend somewhat beyond the end faces of the rotatable cylinders and are held at their ends in semicircular mounts in the two halves of the box 38, for example in such a way that the gas guiding bodies have peripheral grooves into which the side edges of the box engage. In this manner the cylinders are fixed in a problem free manner, and, upon opening the box, the individual cylinders with the bodies can easily be removed for example in order to ensure ready insertion of the carded sliver. As shown here, on introducing the carded sliver, the cylinders 11.2 and 11.4 are first arranged in the lower part of the box. The carded sliver is then laid over these two cylinders, and the cylinders 11.2 and 11.4 are then likewise arranged in the lower part of the box 38 on top of the sliver so that the carded sliver adopts the desired snake-like course. Then the upper part of the box is set in place and fixed in its final position for example by clips. Thereafter the arrangement can be taken into operation.

Figure 4:
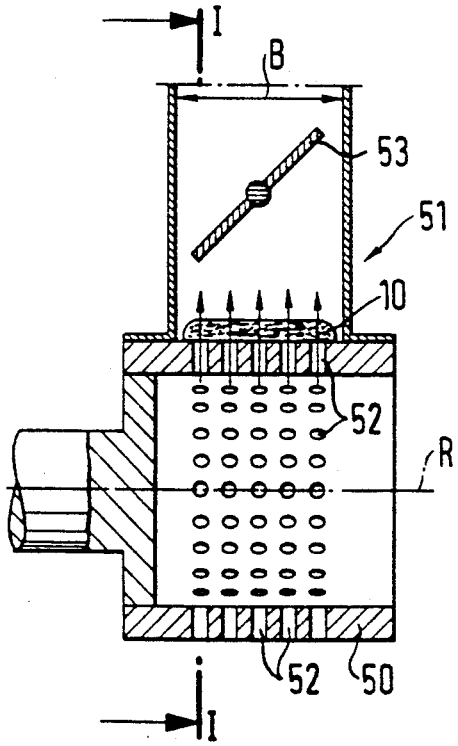
FIG. 4 is an axial cross section of a variant of the apparatus of FIG. 1.
Figure 5:
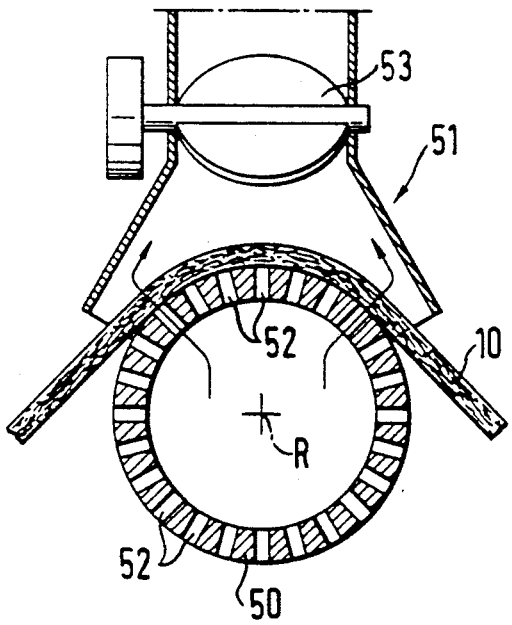
FIG. 5 is a cross sectional view of the apparatus of FIG. 4 taken along the line I—I in FIG. 4.

FIGS. 4 and 5 show a perforated cylinder 50 which is drivably journalled and rotatable about the rotational axis R. The cylinder 50 is covered over by a suction hood 51 in the deflection region (indicated at 16 in FIG. 1) of the carded sliver 10 and indeed with a width B which is larger than the width (not shown) of the carded sliver 10. The suction hood 51 serves to suck away the aspiration air which, in accordance with the arrows that are shown, flows into the hollow cavity of the cylinder 50 and through the perforation holes 52 as well through the carded sliver 10 into the suction hood 51. An adjustable restriction flap 53 is provided in the suction hood 51 in order to regulate the quantity of air that is sucked off.

Figure 6:
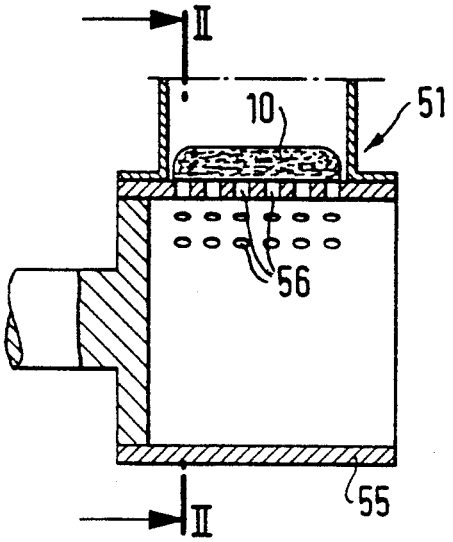
FIG. 6 is a cross sectional view in the axial direction of a further variant of the apparatus of FIG. 1.
Figure 7:
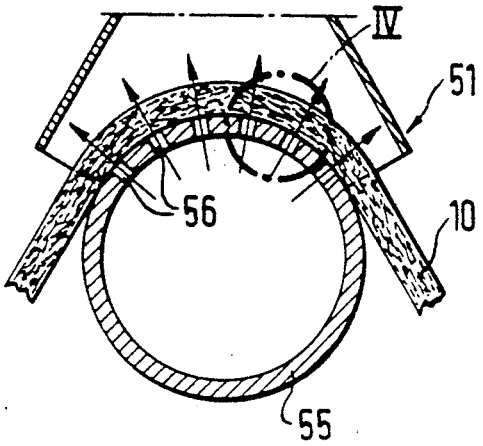
FIG. 7 is a cross sectional view of the apparatus of FIG. 6 taken along the line II—II in FIG. 6.

FIGS. 6 and 7 show a further perforated cylinder 55 which is arranged to be stationary during operation of the cleaning system.

Accordingly, the perforation holes 56 are provided only within the deflection regions of the carded sliver 10. The cylinder 55 is covered over in the same manner by the suction hood 51 already shown in FIGS. 4 and 5. The sucked-in air has the flow direction shown by the arrows.

Advantageously, the cylindrical surface of the perforated cylinder 55 is treated in the deflection zone of the carded sliver 10 by a surface treatment which results in a so called orange skin. The carded sliver slides better on a surface of this kind than on an untreated surface or surface which is too smooth.

Figure 8:
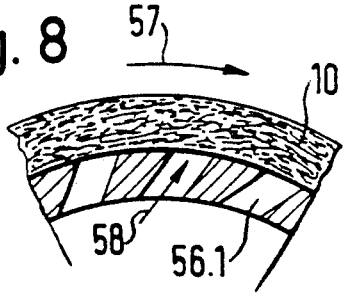
FIG. 8 is an enlarged view similar to the portion of FIG. 7 indicated by the dot-dash line circle IV, but showing a modified construction.

FIG. 8 shows section-wise a variant of the perforations of FIG. 7 in which the perforation holes 56.1 are not radially arranged but rather, as shown in FIG. 8, have a direction inclined in the direction of movement of the carded sliver 10. The direction of movement is characterized by the arrow 57. Through the inclination of the perforation holes shown in FIG. 8, the air which flows in and which is illustrated by an arrow 58 has the task not only of releasing dust and contamination particles out of the carded sliver 10 but also of conveying the carded sliver in the conveying direction 57. The quantity of air, the air speed which is required, and the degree of perforation hole inclination required in particular situations can be determined experimentally in tests. Through this measure at least a smaller tension force has to be exerted on the carded sliver in order to convey the latter in the conveying direction 57.

Figure 9:
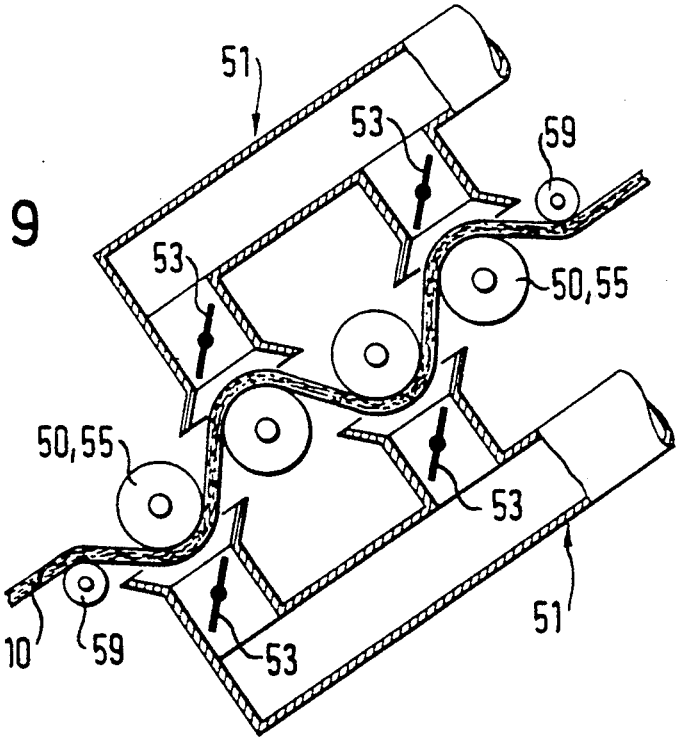
FIG. 9 is a schematic illustration of another embodiment having some similarity to the apparatus of FIG. 2.

FIG. 9 illustrates the use of either the perforated cylinder of FIGS. 4 and 5 and/or the perforated cylinder of FIGS. 6 and 7, in particular in combination with the perforation holes 56.1 of FIG. 8. It is evident from FIG. 9 that each cylinder is subject to the suction through the suction hood 51 which is associated with a vacuum source (not shown). The restriction flaps 53 make it possible to ensure a separate and/or joint control of the flows through the individual throughflow regions of the carded sliver.

Deflection rollers 59 can be provided in order to ensure the wrap of the carded sliver 10 before the first and after the last cylinders 50 and 55 respectively. These deflection rollers are advantageous rotatably and drivably journalled.

Furthermore, when using the cylinders 50 and 55 respectively, one advantageously proceeds in such a way that the first cylinder in the conveying direction 57 of the carded sliver 10 is a driven cylinder 50 and the following cylinder is a stationary cylinder 55 which is then followed by a driven cylinder 55 and finally by a stationary cylinder 50. Depending on the degree of wrapping and on the carded sliver, it is also possible to select a different sequence.

Figure 10:
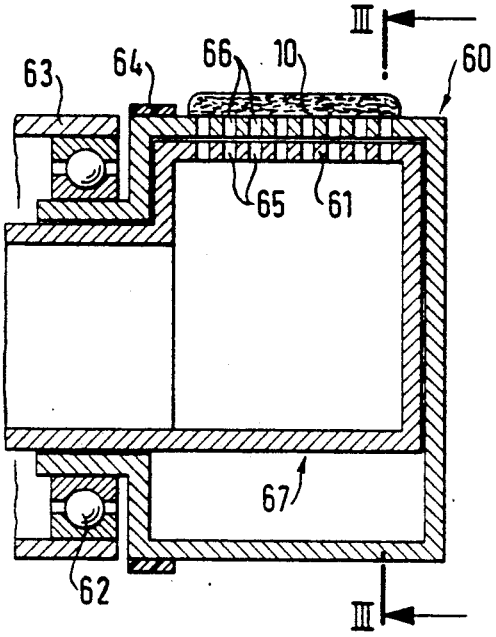
FIG. 10 is a cross sectional view in the axial direction of another variant of the apparatus of FIG. 1.
Figure 11:
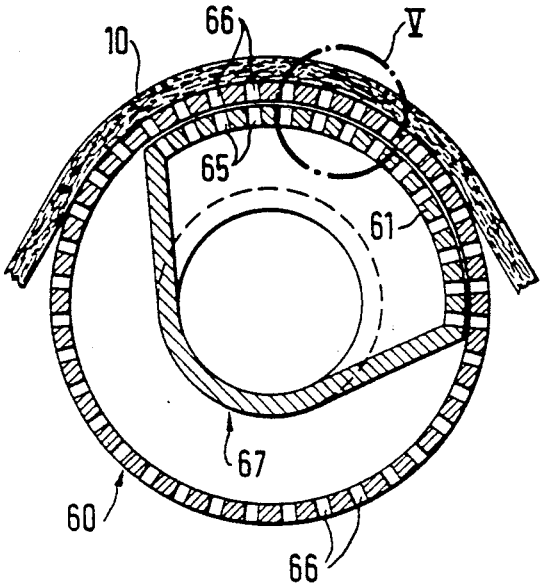
FIG. 11 is across sectional view of the apparatus of FIG. 10 taken along the section line III—III in FIG. 10.

FIGS. 10 and 11 show a perforated cylinder 60 which is rotatably journalled by means of a ball bearing 62 in a stationary housing part 63 and which is driven by a belt 64. This kind of rotatable mounting and this type of drive can be used for all previously shown cylinders and for all the cylinders which will be described in the following.

In the interior of the perforated cylinder 60 there is provided a stationary perforated part 61 the perforation holes 65 of which match the perforation holes 66 of the rotatable cylinder 60. The stationary perforated part 61 is part of an air input element 67 which is either opened to the atmosphere in order to allow suction air to flow in or is connected with a pressure air source in order to blow pressure air through the perforation holes 65 and 66 respectively.

Through the use of stationary perforations 65 and a moving perforations 66, the air flow is repeatedly interrupted. Hence, a pulsing air flow exits from the perforations 66 to exert a beating effect on the carded sliver 10. Through this beating effect, the dust and contamination particles separate out better than with a continuous air stream.

Figure 12:
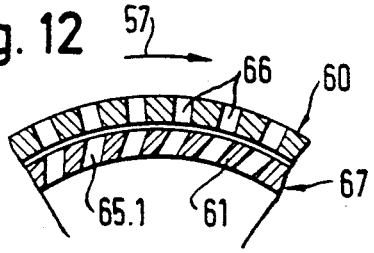
FIG. 12 is an enlarged view similar to the portion of FIG. 11 indicated by the dot-dash line circle IV, but showing a modified construction.

FIG. 12 shows perforation holes 65.1 which are likewise inclined in the conveying direction, making use of the consideration of FIG. 8 in which the stationary perforation has an inclination in the conveying direction 57 of the fiber sliver 10. In this way the kinetic energy of the air stream in the perforation hole 65.1 can be used by means of the deflection into the radial direction of the perforation hole 66 for the drive of the rotatable cylinder 60. With such an arrangement, the belt drive 64 may be unnecessary in some applications. Again, the inclination of the perforation holes 65.1, the pressure of the flow and the quantity of air are factors to be determined in particular instances for appropriate tests. The values selected should be suitable for the purpose of driving the cylinder 60 but also for the purpose of cleaning the carded sliver 10.

Figure 13:
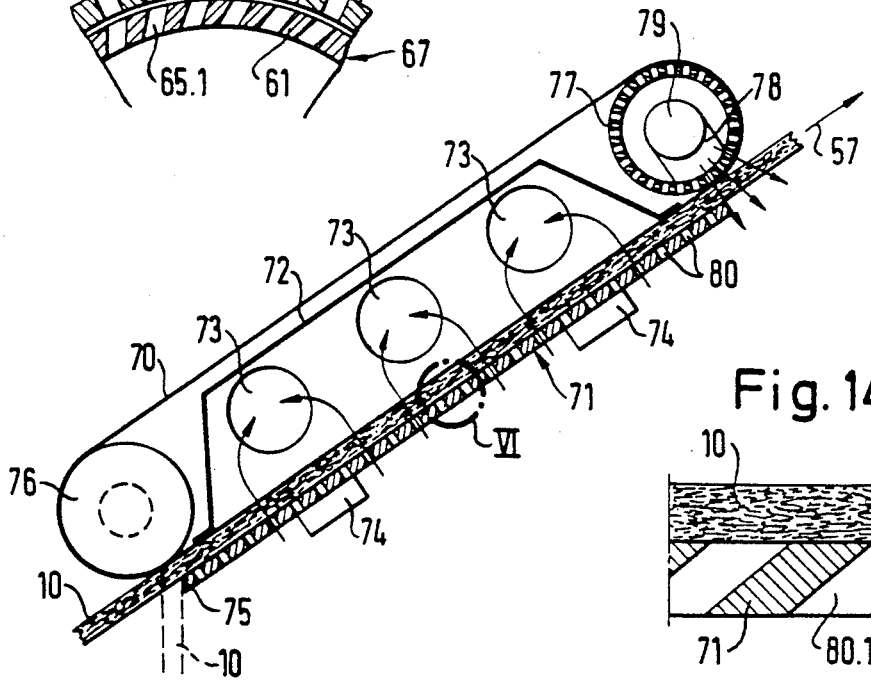
FIG. 13 is a schematic illustration of an apparatus for use of the method of the invention.

FIG. 13 shows a variant of the use of the method. In this embodiment, the carded sliver 10 is moved in the conveying direction 57 between a perforated conveyor band 70 and a stationary perforated plate 71. A suction hood 72 is provided within the conveyor band 70 in such a way that air can flow through the carded sliver portion which lies above the perforated region of the plate 71 without an unacceptable proportion of leakage air likewise being sucked in through the suction hood 72. The suction hood 72 has suction openings 73 which open into a vacuum source, for example a suction fan.

By sucking the air through the perforated plate 71, an air layer arises between the carded sliver and the surface of the plate 71 so that the friction between this carded sliver 10 and the surface of the plate is strongly reduced by this air layer. Nevertheless, it can be of advantage to provide the surface of the perforated plate 71 with an orange skin as already described in conjunction with the apparatus of FIG. 6.

Moreover, the plate 71 can be provided with vibrators 74 with a high frequency and low stroke in order to achieve a beating effect on the carded sliver 10, which has already been described, and which facilitates the sucking off of the dust and contamination particles out of the carded sliver.

Also, as indicated with broken lines, the carded sliver can be guided at the entry of the conveyor band 70 around a curved edge 75 of the plate 71 so that, by guidance of the fiber band 10 around a rounded edge 75, a spreading of the fiber sliver 10 is caused which likewise leads to improved removal of the dust and contamination particles in conjunction with the suction effect.

At the entry of the conveyor band 70, the latter is provided with a drive roller 76. At its outlet, there is a perforated deflection roller 77. This perforated roller 77 serves the purpose of separating the fiber sliver 10 from the perforated conveyor band. For this purpose, the perforated deflection roller has a blowing channel 78 at its center which is connected via an inlet stub 79 with a source of pressurized air (not shown). The blowing channel covers over the perforations of the deflection roller 77 in which the fiber sliver 10 contacts the deflection roller 77.

Figure 14:
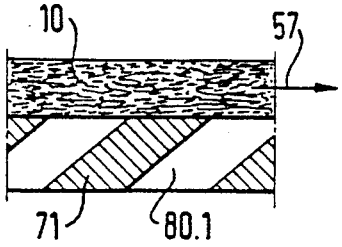
FIG. 14 is an enlarged view similar to the portion of FIG. 13 indicated by the dot-dash line circle IV, but showing a modified construction.

For purposes analogous to those discussed in connection with FIGS. 8 and 12, the plate 71 may (as shown in FIG. 14) have perforation holes 80.1 which are inclined in the conveying direction 75 of the fiber sliver 10. This measure assists the conveying of the fiber sliver 10 on the plate 71.

Still other modifications of the invention will suggest themselves to persons skilled in the art. It is intended therefore that the foregoing disclosure of certain embodiments be considered as exemplary and that the scope of the invention be ascertained from the following claims.

What is claimed is:

1. A method of cleaning a card sliver during movement thereof in a longitudinal direction, comprising guiding the carded sliver around at least one convexly curved guide surface having perforations so as to cause a spreading or loosening of said sliver, and generating a gas stream through said perforated guide surface and through and away from said loosened sliver in order to remove loose contamination and also dust and dirt particles present in the loosened sliver.

2. A method according to claim 1, wherein said gas stream is an air stream.

3. A method in accordance with claim 1, wherein the gas flow penetrates through the card sliver and is sucked away.

4. A method in accordance with claim 1, wherein the card sliver is guided over a stationary guide surface.

5. A method in accordance with claim 1, wherein the card sliver is conveyed over a movable guide surface.

6. A method in accordance with claim 1, wherein the carded sliver is drawn over another convexly curved surface before it reaches said convexly curved guide surface having perforations therein.

7. Apparatus for cleaning a carded sliver, by carrying out the method of claim 1, wherein the perforated guide surface is formed by a perforated cylinder within which there is provided a body which guides the gas stream and has a gas outlet opening, with the gas outlet opening being arranged in the region where the sliver surrounds the cylinder in order to blow the gas through and away from the sliver.

8. Apparatus in accordance with claim 7, wherein a suction device is provided in the wrapping region and on the side of the carded sliver remote from the cylinder.

9. Apparatus in accordance with claim 8, wherein the gas flow is generated by the suction means.

10. Apparatus in accordance with claim 7, wherein the gas flow is fully or partially generated by a through-flow source which acts on the body guiding the gas flow.

11. Apparatus in accordance with claim 7, wherein said perforated cylinder is formed to execute oscillations, for example axial and/or radial oscillations.

12. Apparatus in accordance with claim 7, wherein said cylinder is made to rotate in operation.

13. Apparatus in accordance with claim 7, wherein said cylinder is of stationary construction.

14. A method of cleaning a card sliver during movement thereof in a longitudinal direction, comprising guiding the card sliver in snake-like manner around several convex guide surfaces each having perforations so as to cause a spreading or loosening of said sliver at each of said convex guide surfaces, and generating a gas stream through said perforated guide surfaces in order to remove loose contamination and also dust and dirt particles present in the loosened sliver.

15. A method of cleaning a card sliver during movement thereof in a longitudinal direction, comprising guiding the carded sliver around at least one convexly curved guide surface having perforations so as to cause a spreading or loosening of said sliver, generating a gas stream through said perforated guide surface in order to remove loose contamination and also dust and dirt particles present in the loosened sliver, and subjecting the carded sliver to vibrations on the guide surface.

16. A method of cleaning a card sliver during movement thereof in a longitudinal direction, comprising contacting a portion of the sliver from a side thereof to displace somewhat the fibers of the contacted portion of the moving sliver, and flowing a gas stream through and away from the contacted portion of the sliver to remove contaminants from the displaced fibers of the sliver.

17. A method according to claim 16, wherein said contacting is accomplished by guiding said sliver over a guide surface having perforations therein, and wherein said gas stream flows through said perforations while said sliver is in contact with said surface.

18. Apparatus for cleaning a card sliver by a method in which the longitudinally moving sliver is passed over and at least partly around convexly curved perforated guide surface means with gas moving out of the perforations and through the sliver portions in contact with the convex guide surface means, said apparatus comprising several perforated cylinders providing said perforated guide surface means; a body within each said cylinder for guiding the gas stream and having a gas outlet opening in the region where the sliver surrounds such cylinder; said several perforated cylinders being in a row in the direction of movement of the sliver with the sliver partly wrapping around the cylinders in snake-like manner; and suction means on at least one side and preferably on both sides of the cylinder row.

19. Apparatus in accordance with claim 18, wherein the suction means has the form of a box through which the carded sliver runs and which surrounds the cylinder row and has a suction connection.

20. Apparatus in accordance with claim 18, wherein each suction means has the form of an elongate trough which tapers in the direction of movement or in the opposite direction of the sliver and is arranged with its open side facing the sliver; and wherein the suction connection is provided at the broader end of the trough.

21. Apparatus in accordance with claim 20, wherein the open side of the trough is only open at positions where the sliver runs between the cylinders and the trough.

22. Apparatus for cleaning a card sliver by a method in which the longitudinally moving sliver is passed over and at least partly around a convexly curved perforated guide surface with gas passing through the perforations and through the sliver portion in contact with the convex guide surface, said apparatus comprising a perforated cylinder providing said perforated guide surface, a body within said cylinder for guiding the gas stream and having a gas outlet opening in the region where the sliver surrounds the cylinder, and wherein the gas flow is a pulsing gas flow.

23. Apparatus for cleaning a card sliver by a method in which the longitudinally moving sliver is passed over and at least partly around a convexly curved perforated guide surface with gas passing through the perforations and through the sliver portions in contact with the convex guide surface, said apparatus comprising a perforated cylinder which rotates in operation and provides said perforated guide surface; and a stationary perforated part within the perforated cylinder; the perforations of the cylinder and of the stationary part being alternately in and out of registry with one another as the cylinder rotates in order to obtain a pulsating air flow through the perforations in operation.

24. Apparatus in accordance with the claim 23, wherein the perforated holes which open into the guide surfaces are inclined in the conveying direction of the fiber sliver in order to obtain a conveyance of the fiber sliver which is aided by the air which is blown therethrough.

25. Apparatus for cleaning a card sliver by a method in which in which the longitudinally moving sliver is passed over and at least partly around a convexly curved perforated guide surface with gas passing through the perforations and through the sliver portion in contact with the convex guide surface, said apparatus comprising a perforated cylinder of stationary construction providing said perforated guide surface, and a body within said cylinder for guiding the gas stream and having a gas outlet opening in the region where the sliver surrounds the cylinder, wherein the perforated holes which open into the guide surfaces are inclined in the conveying direction of the fiber sliver in order to obtain a conveyance of the fiber sliver which is aided by the air which is blown therethrough.

26. The combination with a carding machine for producing a card sliver and a coiler for such sliver, of sliver cleaning apparatus for removing contaminants from said sliver as it passes lengthwise from said carding machine to said coiler, said cleaning apparatus comprising a guide having a convexly curved guide surface and having perforations therethrough leading to said convexly curved guide surface, means for passing said sliver around and in contact with at least a portion of said convexly curved guide surface in overlying relation to the adjacent ones of said perforations as the sliver passes toward the coiler, and means for causing a gas to flow through said perforations and out through a portion of said convexly curved guide surface contacted by the sliver so as to pass through said sliver to displace contaminants from said sliver.

27. Apparatus for cleaning card sliver, comprising at least one cylinder having inner and outer surfaces and being provided with perforations extending between said inner and outer surfaces, means for providing a sliver path around and in contact with a portion of the outer surface of said cylinder overlying adjacent ones of said perforations to cause loosening and spreading of the sliver, and means for causing air to flow out of said cylinder through said perforations and through the loosened and spread sliver in contact with said outer surface of said cylinder to displace contaminants from said sliver.

28. Apparatus according to claim 27, wherein said means for causing air to flow out of said cylinder through said perforations includes suction means for drawing air from the side of the sliver opposite the side in contact with said cylinder.

29. Apparatus according to claim 27, wherein there are a plurality of said cylinders and wherein the sliver passes successively around surface portions of each of said cylinders with air being passed through the sliver portions in contact with the several cylinders to remove contaminants from the sliver at a plurality of locations.

30. A method of cleaning a card sliver during a movement thereof in a longitudinal direction over a guide member having as a first surface, a convexly curved second surface and perforations extending between said surfaces, comprising passing the sliver around the convexly curved surface of said guide member to spread a portion of the sliver; and causing a gas stream to flow through said perforations in the direction from said first surface toward said convexly curve surface and then through said spread portion of said sliver to remove contaminant particles from the sliver.

* * * * *

UNITED STATES PATENT AND TRADEMARK OFFICE

CERTIFICATE OF CORRECTION

PATENT NO. : 5,031,280

DATED : July 16, 1991

INVENTOR(S) : Robert DEMUTH

It is certified that error appears in the above-identified patent and that said Letters Patent is hereby corrected as shown below:

On the title page, item [73]

Amend

"[73] Assignee: Maschinenfabrik Reiter AG,"

to --[73] Assignee: Maschinenfabrik Rieter AG,"

Signed and Sealed this

Twenty-second Day of December, 1992

*Attest:*

DOUGLAS B. COMER

*Attesting Officer*

*Acting Commissioner of Patents and Trademarks*